US005949311A

United States Patent [19]

Weiss et al.

[11] Patent Number: 5,949,311

[45] Date of Patent: Sep. 7, 1999

[54] TUNABLE RESONATORS

[75] Inventors: Jerald A. Weiss, Wayland; Donald H. Temme, Concord; Gerald F. Dionne, Winchester, all of Mass.

[73] Assignee: Massachusetts Institute of Technology, Cambridge, Mass.

[21] Appl. No.: 09/018,154

[22] Filed: Feb. 3, 1998

Related U.S. Application Data

[60] Provisional application No. 60/048,854, Jun. 6, 1997.

[51] Int. Cl.[6] ..... H01P 1/20; H01P 1/217

[52] U.S. Cl. ..... 333/202; 333/205; 333/219.1; 333/235

[58] Field of Search ..... 333/202, 204, 333/205, 219, 219.2, 235

[56] References Cited

U.S. PATENT DOCUMENTS

| | | | |
|---|---|---|---|
| H432 | 2/1988 | Mariani et al. | 333/205 |
| H470 | 5/1988 | Stern et al. | 333/1.1 |
| H1408 | 1/1995 | Babbitt et al. | 333/1.1 |
| 3,986,149 | 10/1976 | Harris et al. | 333/24.1 |
| 4,020,429 | 4/1977 | Bickley | 333/205 |
| 4,027,253 | 5/1977 | Chiron et al. | 333/1.1 |
| 4,152,677 | 5/1979 | Chiron et al. | 333/24.2 |
| 4,521,753 | 6/1985 | Schloemann | 333/204 |
| 4,816,787 | 3/1989 | Stern et al. | 333/158 |
| 4,887,054 | 12/1989 | Stern et al. | 333/158 |
| 5,101,182 | 3/1992 | Babbitt et al. | 333/205 |
| 5,223,808 | 6/1993 | Lee et al. | 333/24.1 |
| 5,309,127 | 5/1994 | Mariani | 333/202 |
| 5,413,983 | 5/1995 | Stern et al. | 505/211 |
| 5,426,402 | 6/1995 | Mariani | 333/205 |
| 5,448,211 | 9/1995 | Mariani | 333/205 |
| 5,770,546 | 6/1998 | Grothe et al. | 333/205 X |

OTHER PUBLICATIONS

Mesa, F., et al., "Rigurous Analysis of Non–Reciprocal Slow–Wave Planare Transmission Lines," 21 European Conference, 1991, Microwavee Exhibitions and Publishers, 1991, pp. 229–234.

Dionne, G., et al., "Tunabilty of Microstrip Ferrite Resonator in the PArtially MAgnetized State," *IEEE Transactions on Magnetics,* vol. 33, No. 5, Sep. 1997, pp. 3421–3123.

*Primary Examiner*—Seungsook Ham
*Attorney, Agent, or Firm*—Lappin & Kusmer LLP

[57] ABSTRACT

In a magnetically-tunable resonator, a wave-guiding structure comprising an electromagnetic frequency filter, or component of such a filter, is placed in sufficient proximity with a magnetic structure so as to be gyromagnetically coupled therewith. The resonator is supportable of two fundamental normal modes of propagation which, in the absence of magnetic interaction are even and odd with respect to the resonator center plane of symmetry. Each normal mode possesses a spectrum of resonance frequencies. When the magnetic structure is magnetized, the formerly even and odd modes become mixed due to gyromagnetic interaction, and the resulting wave fields become elliptically polarized. With appropriate design such that the identities of the modes are preserved under conditions of resonance, this in turn results in a nonreciprocal reinforcement action in the resonator, which leads to the desired shift in resonance frequency in at least one of the two normal modes. The device is especially attractive to application in miniaturized planar microwave devices, for example MMICs, in conferring small size and weight, simplicity of structure, low power required for tuning, capability of fixed, continuous or digitally-stepped frequencies, and low-loss high-Q performance; applicable with superconducting or conventional metallic conductors.

30 Claims, 8 Drawing Sheets

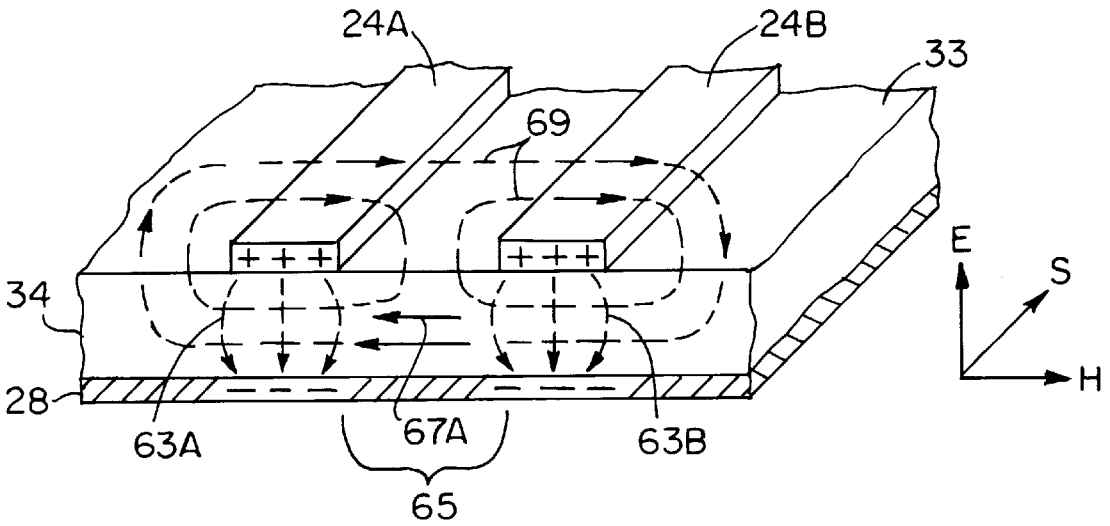
FIG. 2A EVEN MODE
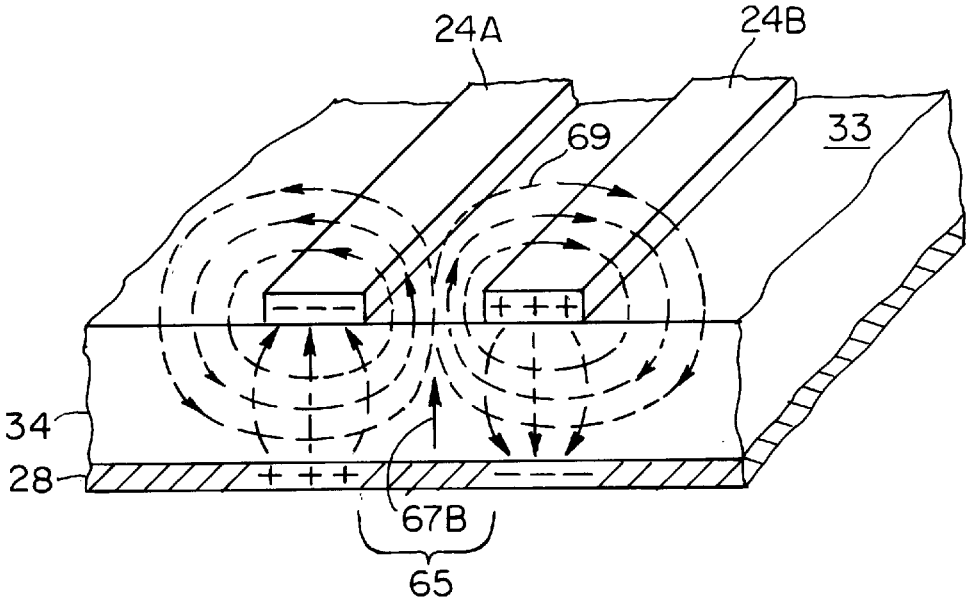
FIG. 2B ODD MODE

TUNABLE RESONATORS

RELATED APPLICATIONS

This application claims the benefit of U.S. Provisional Application No. 60/048,854, filed Jun. 6, 1997, the contents of which are incorporated herein by reference.

GOVERNMENT SUPPORT

The Government has rights in this invention pursuant to Contract Number F 19628-90-C-0002, awarded by the United States Air Force.

BACKGROUND OF THE INVENTION

An electromagnetic filter provides frequency-dependent attenuation of electromagnetic signals propagating through a circuit. A bandpass filter selectively permits signals of frequencies within a predetermined passband to pass with minimal loss, while a stopband filter, also referred to as a notch or band-reject filter, suppresses signals of frequencies within a predefined rejection band. A variety of frequency-dependent attenuation profiles are obtainable by combining the properties of band-reject and bandpass filters. Filters can be further categorized as passive or active, and fixed- or variable-tuned.

Fundamental to filter configurations is a resonator designed to resonate, or "ring" at a prescribed resonance frequency. In well-known multipole filters, for example, the impedance and admittance poles of the filter are conferred by a multiplicity of resonators suitably coupled to one another and to the associated circuit. The resonator may be of the "lumped-element" type, composed of an inductor L and a capacitor C, a combination which is well known to possess the resonance frequency $f_o=1/(2\pi\sqrt{LC})$ at which it spontaneously oscillates if excited, for example by means of an initial electric charge stored in the capacitor. If stimulated by means of an externally applied AC signal of frequency $f$,the resonator exhibits a more or less sharply defined peak in impedance (if L and C are connected in parallel) or admittance (L and C in series) in the frequency range centered at $f=f_o$. Or, the resonator may be of the transmission-line type, comprising a segment of transmission line relatively isolated from its associated circuit. In a well-known typical embodiment, the length of the segment is an integer multiple of one-half wavelength at the desired resonance frequency $f_o$. In an alternative embodiment, namely a transmission line in the form of a closed loop or ring, resonance occurs when the length is an integer multiple of one wavelength. Transmission-line and lumped-element resonators respond to electrical stimulation in precisely analogous fashion in the vicinity of their respective resonance frequencies; the principal difference in performance between the two is in that the transmission-line resonator exhibits a succession, or spectrum, of harmonic, or overtone resonance frequencies occurring when the length of the resonator equals an integer number of half-wavelengths. The excitation of a transmission-line resonator may be visualized as a propagating wave undergoing repeated internal reflections as it collides with the discontinuities at opposite ends of the transmission-line segment, or as a propagating wave closing in phase on itself in the ring resonator embodiment. In this respect, the resonance is analogous to that observed in musical instruments such as organ pipes and violin strings.

A filter whose passband or stopband is tunable by means of an electric control circuit has been the subject of active consideration for a variety of microwave systems, including radars and wireless telecommunication systems. To confer tunability, materials whose electromagnetic properties can be varied, such as ferroelectrics and ferrimagnetics, have been investigated for use as substrates on which planar-circuit resonator patterns are applied, thus providing means to control the effective propagation length, hence to vary the resonance frequencies. The method of present concern depends on the use of ferrimagnetic substrate materials whose permeability is controlled by application of a magnetic field. Examples include U.S. Statutory Invention Registration No. H432, and U.S. Pat. Nos. 5,426,402 and 5,448,211 to Mariani, directed to tunable band-rejection filters formed on dielectric/magnetic substrates. In each example, resonant slotlines are provided on a metallic surface proximal to a magnetized ferrite substrate. The permeability of the ferrite substrate changes as a function of the intensity of an applied magnetic field. This in turn changes the effective electromagnetic path length of the resonant slots and accordingly shifts the resonance frequency of the filter. Alternative control methods include use of ferroelectric materials whose permittivity can be electrically varied as described in Beall, J. A. et al, "Tunable High-Temperature Superconductor Microstrip Resonators", Digest of IEEE MTT-S International Microwave Symposium (1993), incorporated herein by reference.

The above example of prior art magnetically tunable filters and others generally require a high magnetic field to drive the substrate into a state of magnetic saturation and further to a condition such that magnetic resonance effects dominate the variation of permeability. This requirement imposes several disadvantages, including inconveniently large, heavy, and intricate magnet structures as well as limited speed and range of tuning. Furthermore, the strong magnetic fields in the prior art embodiments are generally oriented normal to the substrate, which gives rise to at least two disadvantages: incompatibility with superconducting performance; and the presence of a strong demagnetizing effect, therefore requiring a strong external field for operation. For these reasons, magnetically tunable filters have not lent themselves to the evolving technology of microwave planar circuits, in which minimization of size, weight, cost, and dissipative energy loss, and maximization of tuning or switching speeds are usually essential.

SUMMARY OF THE INVENTION

The present invention is directed to a resonator having a magnetically-tunable resonance frequency. The invention comprises a resonator in sufficient proximity with a magnetic structure so as to be gyromagnetically coupled therewith.

The resonator supports two fundamental normal modes of propagation which, in the absence of magnetic interaction, are even and odd with respect to the center plane of symmetry. Each mode possesses a spectrum of resonance frequencies.

When the magnetic structure is magnetized, the normal modes, which were formerly even and odd, become mixed due to the gyromagnetic interaction. The new normal modes are in general elliptically polarized with respectively right and left chirality (handedness). The propagation constants, hence velocities of propagation, of the modes are changed in accordance with the dependence of the magnetic properties of the medium on the Polder permeability tensor which characterizes the gyromagnetic interaction. If the design of the resonator is such that each of the two modes produces its own resonance, then the result is a nonreciprocal reinforcement action in the resonator which leads to the desired magnetically-controlled resonance frequencies. The optimal design is that in which the chiralities of the modes are preserved; i.e. internal reflections do not convert one handedness of elliptical polarization into the other. Chirality preservation is effected by creation of suitable boundary conditions at the ends by means of appropriate resonator design. In the case of a ring or loop resonator, a similar preservation of chirality is favored due to the cyclic nature of the boundary condition for propagation around the ring.

For optimally wide-band tuning with minimal control power, a preferred embodiment exploits conditions such that the variation of the effective permeability is favorable in the partially-magnetized regime between the unmagnetized state and magnetic saturation. In this range, with suitably selected substrate materials, the applied magnetic field requirement is relatively small, on the order of 0–10 oersteds, and signal loss due to microcrystalline disorder under conditions of partial magnetization can be minimized. By selection of suitable substrate material, a favorable combination of low loss and large variation of permeability can be achieved, allowing for optimal tunability of the resonance frequencies.

In a first preferred embodiment, the apparatus of the invention comprises a resonator structure supportable of first and second modes of substantially orthogonal polarizations gyromagnetically coupled to a magnetic structure. The degree of magnetization in the magnetic structure determines the microwave permeability, which in turn affects the velocity of microwave propagation, hence the effective path length of the resonator as a function of frequency. In this manner, the resonance frequencies of the resonator can be tuned by varying the magnetization of the structure.

In a second preferred embodiment intended for incorporation in an integrated circuit, the resonator comprises two parallel transmission lines of equal length, for example balanced stripline, microstrip, or slotline. The lines are preferably oriented such that the direction of magnetization of the structure is parallel to the propagation direction of the resonator. Transducers are coupled to each end of the resonator for coupling or launching energy into and extracting energy from the resonators. Depending on the coupling configuration, the resonator may perform as a bandpass or bandstop filter, or a component thereof. For the purpose of enhancing the magnitude of the tuning effect, the resonator may incorporate multiple parallel lines, for example, taking the form of a meanderline. Other resonator configurations are possible within the scope of the invention, including planar ring meanderline, planar notch, and circular-cylindrical waveguide.

The magnetic substrate structure is preferably configured in a closed-loop path, i.e. generally of toroidal topology, such that discontinuities, hence the magnetic reluctance of the flux path, are minimized. Such a configuration is compatible with an embodiment employing a resonator formed of superconducting material, as well as advantageous in terms of weight and tuning speed.

The invention is especially attractive to application in miniaturized planar microwave devices, for example MMICs, in conferring small size and weight, simplicity of structure, low power required for tuning, capability of fixed, continuously varied or digitally-stepped frequencies, and low-loss high-Q performance; applicable with superconducting or conventional metallic conductors.

Note that for purposes of the present invention, the term "conductor" is defined herein to include a conductive-tube waveguide, a microstrip conductor, a stripline or balanced-stripline conductor, a wire, a cable, any of which may be a superconductor; or, a dielectric waveguide, or other media suitable for guidance of an electromagnetic signal. Furthermore, the term "toroidal", when used to describe the shape of magnetic structures, signifies toroidal topology, and includes any continuous, closed-loop structure, within which magnetic flux is substantially confined. In use of the terms "even" and "odd", the convention is observed of referring to the symmetry of the electric field of an electromagnetic wave. Note also that the terms "input" and "output" as used herein when referring to ports and transducers are used for the purpose of clarity only and are freely interchangeable.

BRIEF DESCRIPTION OF THE DRAWINGS

The foregoing and other objects, features and advantages of the invention will be apparent from the more particular description of preferred embodiments of the invention, as illustrated in the accompanying drawings in which like reference characters refer to the same parts throughout the different views. The drawings are not necessarily to scale, emphasis instead being placed upon illustrating the principles of the invention.

FIGS. 2A and 2B are sectional views of the planar parallel-line configuration, illustrating conditions for gyromagnetic interaction between the magnetization in the ferrite and the magnetic field of a signal traversing the resonator, in accordance with the present invention.

DETAILED DESCRIPTION OF PREFERRED EMBODIMENTS

Figure 1:
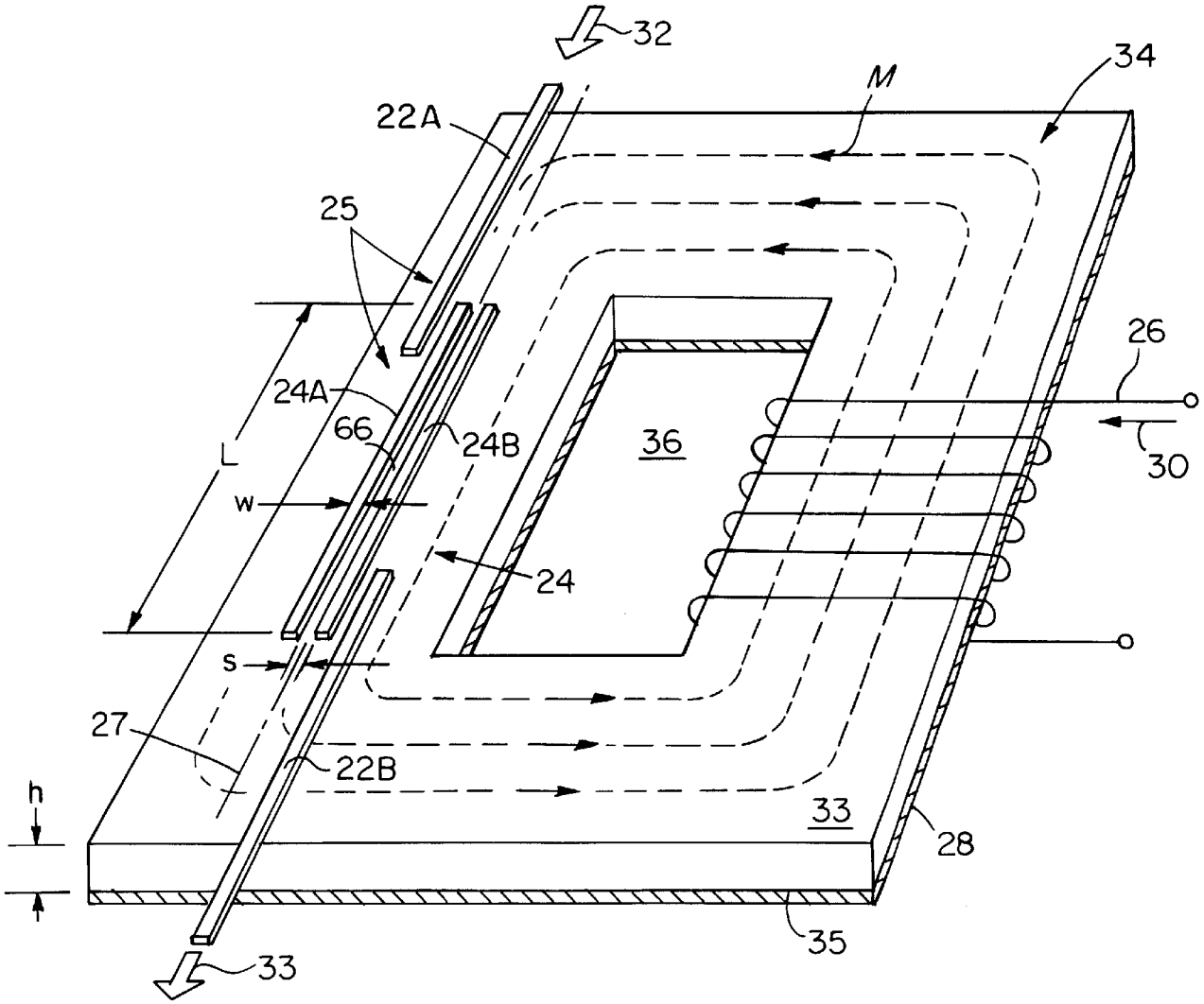
FIG. 1 is a perspective view of a planar circuit resonator having a gyromagnetic substrate for magnetically-controlled tuning in accordance with the present invention.

The present invention is directed to a tunable resonator. A wave-guiding structure, for example a microstrip conductor, is disposed sufficiently proximal to a magnetic structure having a magnetization M such that an electromagnetic signal propagating through the waveguide interacts gyromagnetically with the magnetization of the structure. The magnetic state of the structure is adjustable for varying the propagation velocity of the signal traversing the waveguide. By configuring the waveguide as a resonator, its resonance frequency is tunable as a function of magnetic state.

The resonator waveguide of the present invention is configured such that it is capable of supporting at least two fundamental normal modes of propagation. Under conditions of the present invention, each of the two exhibits resonance at a frequency corresponding to its own velocity of propagation and to the length of the resonator. When the magnetic structure is magnetized, the formerly normal modes become mixed due to gyromagnetic interaction. The propagation constants of the two normal modes change as specified by their dependence on the well-known Polder permeability tensor. The magnitudes of these changes are most favorable when the new normal modes are elliptically polarized and when the resonator design is such as to preserve their individual identities. In this case, at the resonance corresponding to each normal mode, the wave undergoes a nonreciprocal reinforcement. At least one of the resonances can possess an advantageous, i.e. strong, dependence of its resonance frequency on the tensor permeability components.

The components of the Polder permeability tensor which are responsive to the magnetic state of the medium are the "diagonal" component $\mu$ and the "off-diagonal" component $\kappa$. In the range of low magnitude of the internal magnetic field $H_o$, which is of interest for the present invention, $\mu$ does not deviate a great deal from one (unity), but $\kappa$ depends linearly on the magnetization M, which may be made to vary widely, with application of a magnetizing field $H_o$ of only a modest magnitude, between the unmagnetized and remanent states. In that range, the ratio $\kappa/\mu$, which characterizes the gyromagnetic interaction, is approximately equal to $f_M/f$, where $f_M=2\gamma M$ and $f$ is the microwave frequency; $\gamma$ is the gyromagnetic constant. Thus, $\kappa/\mu$ depends on the first power of M (i.e., linear dependence) and inversely on the first power of frequency. For a strong effect, a large range of M in relation to frequency is preferred, insofar as that does not lead to undesirable consequences. (The most significant effect to be avoided under operating conditions of partial magnetization is that known as "low-field loss," which results from an unfavorable relationship between saturation magnetization $M_S$, and frequency. If $M_S$ of the selected material is too large in relation to the contemplated frequency of operation such that $2\gamma M_S/f$ is of the order of unity, then random internal demagnetizing fields arising from magnetic disorder in the partially magnetized medium give rise to local conditions of magnetic resonance, resulting in undesirable dissipative loss. This effect places an upper limit on the magnitude of $M_S$ of the selected substrate material.)

The operation of the invention will now be described in detail with reference to the various figures. FIG. 1 is a perspective view of a preferred embodiment of the present invention. The apparatus of the invention includes a magnetic structure 34, for example a closed-loop gyrotropic ferrite substrate of thickness h. The structure 34 includes a magnetization M which is variable in accordance with a magnetic field induced by a coil 26 when excited by current 30.

A planar waveguide 25 is disposed in sufficient proximity with the magnetic structure 34 so as to interact gyromagnetically therewith. The waveguide 25 includes first and second transducer ports, 22A, 22B, and a resonator structure 24 coupled thereto. In the illustrated embodiment, the resonator 24 and transducers 22A, 22B are capacitively coupled; however alternative coupling configurations are applicable, as illustrated and described below. The long axis 27 of the resonator 24 is preferably oriented in a direction parallel to the magnetization M, as shown, for maximizing the gyromagnetic interaction.

Resonator structures 24 commonly include physical boundaries that define a resonant cavity, within which an electromagnetic signal resonates at a fundamental or overtone frequency. The resonance frequency is related to the geometry of the cavity and the propagation velocity of the signal traversing the resonator. (Loop or ring embodiments incorporate an alternative means to accomplish a similar effect.) An electromagnetic signal 32, launched into transducer port 22A will be substantially reflected, except for that portion of the signal 32 which substantially matches the resonance frequency of the resonator 24 as tuned by coil 26, specifically within a frequency range of $\Delta f$ approximately equal to $\Delta f=f_o/Q$, where $f_o$ is the resonance frequency and where Q is the quality factor of the resonator. The energy of the matching portion will couple into the resonator and pass through port 22B as filtered signal 33.

In a preferred embodiment, the resonator structure 24 comprises at least two parallel transmission lines 24A, 24B of equal length L, spacing s and equal width w. The lines 24A, 24B may comprise conductors, for example microstrip or balanced stripline, and are deposited on a first surface 33 of the substrate 34. An opposite second surface 35 of the substrate 34 is preferably coated with a conductive ground plane 28. The lengths, widths, and relative spacing of the transducer port strips 22A, 22B, and substrate 34 thickness h, can be selected by well-known methods of guided wave theory and practice to yield favorable performance in terms of optimal impedance match and device frequency bandwidth capability.

Planar transmission-line configurations consisting of two symmetrical conductors and a ground conductor, such as a pair of equal strips in microstrip or balanced stripline, support two independent normal modes which may be characterized as even and odd with respect to a central, vertical plane of symmetry (if the medium is non-gyrotropic or unmagnetized). As discussed in U.S. patent application Ser. No. 08/902,702, filed Jul. 30, 1997, by J. A. Weiss, incorporated herein by reference, the conceptual resemblance between this arrangement and the well-known waveguide Faraday rotator may be seen by considering the polarization of the field in the magnetic medium 34 in the vicinity of the gap 66 between the transmission lines 24A, 24B. Referring to FIGS. 2A and 2B, note that in the case of the even mode, FIG. 2A, in the zone 65 between and beneath the two transmission lines 24A, 24B, with electric fields 63A, 63B oriented as shown, the resultant microwave magnetic field 67A is predominantly directed horizontally; in that same region 65, in the case of the odd mode, FIG. 2B, it is predominantly vertical 67B. In each of the even and odd modes, the magnetic field lines 69 wrap around conductors 24A, 24B. Note however, that the odd mode of FIG. 2B includes a field 69 which has a somewhat larger percentage of propagating intensity, or power density, in the air above the surface of the structure and a smaller percentage in the dielectric/magnetic substrate 34 in comparison with the even mode of FIG. 2A. For this reason, the odd mode propagates faster than the even mode, resulting in a difference between the wavelengths of the two modes at a given frequency.

By its definition, for a normal mode, the microwave electric and magnetic field patterns over the cross-section remain unchanged as the wave propagates along the line; therefore, there can be no rotation of the polarization. With a pair of modes propagating simultaneously however, the resultant direction of polarization depends on the phase and amplitude relation between the two. If the velocities of propagation of the two modes are unequal (generally the case in inhomogeneous transmission lines such as microstrip; i.e., having a cross-section partially or not uniformly occupied by non-conducting medium) then the phase relation between the modes established at a given transverse plane is not preserved with distance along the line, but varies continuously in the propagation direction.

Consider the unmagnetized state. Attention is focused on a selected transverse plane, specifically on that part of the plane, the "zone of interest" 65, in the magnetic substrate 34 between the strips 24A, 24B and between the plane of the strips 33 and the ground plane 28, where the direction of polarization is not limited by the presence of conducting surfaces. For example, if the even and odd modes are superposed with equal phase and equal amplitude in the zone, then the magnetic field vector of the even mode (horizontal to the left, in the zone of interest when the phase is 0 degrees) and odd mode (vertical downward in that zone) combine to give resultant polarization tilted to 225 degrees ("7:30 on the clock"). If the odd mode is shifted 180 degrees in phase relative to the even mode, this reverses the direction of the fields of that mode at every point in the cross-section (from vertical downward to vertical upward in the zone), and the resultant polarization is changed to 135 degrees (10:30). In either case, by examining a fixed cross-section of the transmission line vs. time as the wave propagates through it, the magnetic vector oscillates along a fixed line (between 225 and 45 degrees if the modes are in phase, and between 135 and 315 degrees if they are 180 degrees out of phase).

Consider now the case in which the odd mode is shifted to 90 degrees out of phase, lagging behind the even mode (one of the two preferred cases for the present invention) then, on the observed cross-section at one instant the vector of the even mode is maximum leftward and that of the odd mode is momentarily zero; the resultant magnetic field vector is leftward (9:00). One quarter cycle later, the magnetic vector of the even mode has diminished to zero, while that of the odd mode has risen to maximum (vertical downward); the resultant magnetic field vector is downward (6:00). In the next quarter-cycle the even mode field rises to the right, the odd mode field falls to zero (resultant, 3:00); next, the even mode field falls to zero, that of the odd mode rises to vertical upward (resultant, 12:00). Finally, the even mode field rises leftward again, the odd mode field falls to zero (resultant, back to 9:00 as at the start of the cycle). In this manner, counter-clockwise circular polarization of the microwave magnetic field is realized. If the odd mode is shifted to 90 phase degrees ahead of, or leading the even mode, the circular polarization is clockwise (the other preferred case). Thus, the planar transmission-line structure consisting of two conducting strips and a ground plane admits two independent normal modes and the possibility of superposition of the modes to yield circular, or in general elliptical, polarization in either clock sense at a given transverse plane. As pointed out above, the phase relation between the modes generally varies in a continuous manner vs. distance traveled (as perceived at a fixed time), causing the polarization to change continuously, for example from clockwise circular to linear to counter-clockwise and so on.

The character of the normal modes changes when the gyrotropic substrate is magnetized longitudinally: the symmetry of the transmission line is altered, and the normal modes are no longer even and odd, but in general elliptically polarized, due to gyromagnetic interaction. As the medium is magnetized, the velocities of propagation change as characterized by the Polder permeability tensor. The resulting change in wavelength is the origin of the variation in resonance frequency on which the filter tunability depends. It is noteworthy that the elliptically polarized modes in the presence of the magnetized medium partake of the property of all normal modes: the direction and form of polarization does not vary with distance along the line.

Gyromagnetic interaction is a stimulation, by the propagating microwave magnetic field, of the atomic magnetic moments which are responsible for the magnetic properties of the substrate material. The response is a gyroscope-like precessional motion of the magnetic moments with a clockwise, or right-handed, sense (chirality) relative to the direction of magnetization of the substrate. This right-handed sense is dictated by a fundamental relation between the intrinsic angular momentum and magnetic moment of the atomic electrons. A wave which is circularly polarized in the sense synchronous with the precessional motion interacts strongly with the medium and normally undergoes retardation of its velocity of propagation, while a wave circularly polarized in opposition to the precession interacts only weakly, and its velocity is normally affected to a lesser degree. In other words, there is a strong interaction in one sense which is supportive or synchronous with the mode and an opposed interaction in the other sense which is antisynchronous, each interaction having a different effect on the propagation velocity of the elliptically-polarized normal mode. The phenomenon is most striking under conditions of magnetic resonance (a constitutive property of magnetic materials, not related to transmission-line resonances), but those conditions are associated with dissipative effects and therefore are not generally the most favorable for device performance.

As the magnetization is increased, the resonator is subject to the gyromagnetic effects and the normal modes become mixed. As a result, the propagation constants change as specified by their respective dependence on the Polder tensor components $\mu$ and $\kappa$, described above, and their wave fields become elliptically polarized. Under favorable conditions, this in turn produces a nonreciprocal reinforcement action in the resonator which leads to the desired shifts in the resonance frequencies.

Chirality of the resonating elliptically polarized wave field is preserved at the ends of the resonator by providing appropriate boundary conditions. In order to avoid the reversal of chirality on reflection at the ends, the vertical and horizontal components of the elliptically-polarized field must be internally reflected with equal discontinuity in phase. When this condition is satisfied, two distinct resonances with favorable tunability are observed, corresponding to the chiralities of the two modes. Otherwise, the two chiralities (handedness, left or right, relative to the direction of magnetization) of elliptical polarization become superposed, resulting in a cancellation of the nonreciprocal effect, which greatly degrades the performance of the device.

This capability of preserving chirality is of particular significance in relation to gyromagnetism, because this comports with the natural precessional motion of the spinning electrons of the magnetized medium, the source of the phenomenon of gyromagnetism. In consequence, when the gyrotropic substrate is magnetized in the direction parallel to the strips, the interaction with the wave is strongly dependent on the state of magnetization, and furthermore significantly different for the two opposite chiralities of circular polarization. (In order to identify the relation between sense of polarization and sense of precession, it is convenient to apply a "right-hand" rule to determine the sense of electron spin precession: with the right thumb indicating the direction of magnetization, the fingers curl so as to indicate the sense of precession. The modes are designated positive or right-hand for co-rotating with the precession, negative or left-hand for counter-rotating; the term chirality, handedness, refers to this property of the modes.) It is significant that chirality does not depend on the direction of propagation of the wave but only on the direction of magnetization. This property is related to the nonreciprocal nature of the effect.

The degree of gyromagnetic interaction is minimal initially at magnetization M levels near zero, and with increased magnetization causes a shift in the resonance frequency of each normal mode. In this manner, the resonance frequency of the resonator is tunable as a function of the magnetization M of the magnetic structure.

Maximum tunability is conferred in the region of partial magnetization between the positive and negative magnetic saturation levels for the structure. Beyond saturation, additional tunability is possible as additional magnetic field H is applied to the structure. However, in the saturated regime, additional tunability comes at the expense of the requirement of a strong externally applied magnetic field.

Figure 3B:
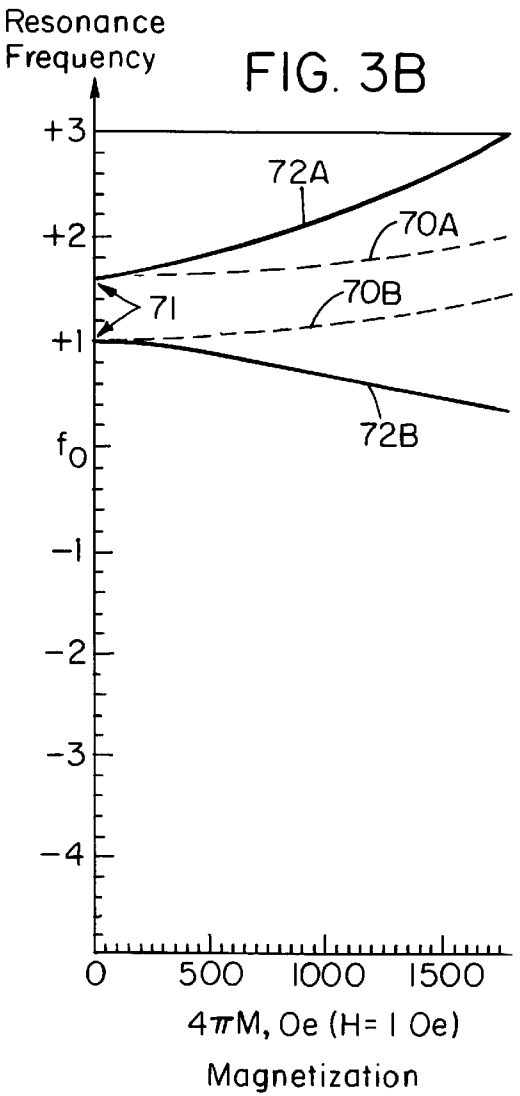
FIGS. 3A and 3B are charts of resonance frequency as a function of magnetization and as a function of applied internal magnetic field illustrating magnetically-controlled tuning in accordance with the present invention and illustrating the nature of tuning under two different operating conditions.
Figure 3A:
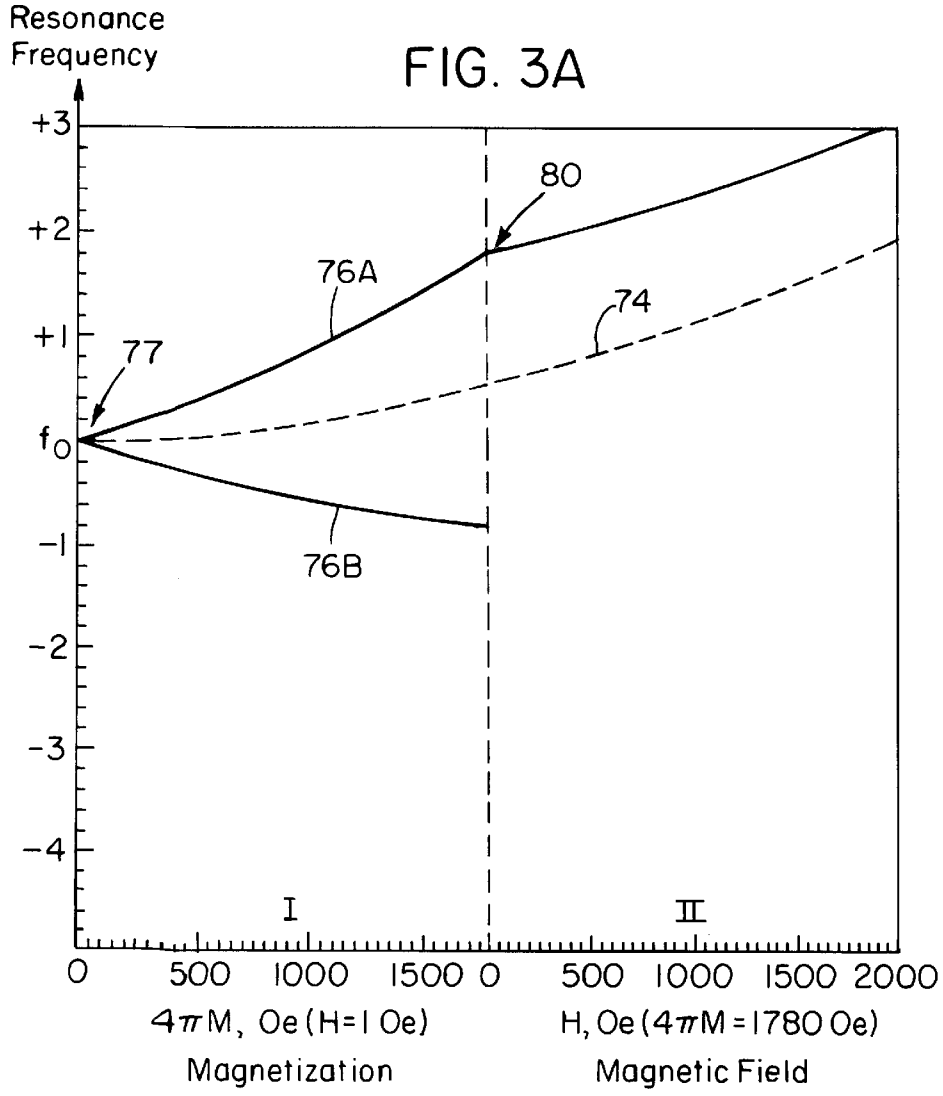

Enhanced tunability of the present invention is illustrated in FIGS. 3A and 3B: a chart of computed resonance frequency, in arbitrary units, as a function of magnetization of the partially-magnetized regime I between zero magnetization and magnetic saturation, with a weak magnetic field (H≈1 Oe), and as a function of H in the saturated regime II. FIG. 3A represents a homogeneous embodiment; for example, configured in balanced stripline having magnetic material both above and below the resonator, as described below with reference to FIG. 6C and FIG. 7. Initially, in the unmagnetized state 77, the resonator structure has a fundamental resonance frequency $f_0$. The dashed line 74 represents the behavior of the resonance under unfavorable conditions, when the boundary conditions at the ends of the resonator are such that the circularly-polarized normal modes of opposite chirality are mutually interchanged on reflection. It is comparable to that of a prior-art single-mode resonator and displays modest tunability in the partially-magnetized region I and in the saturated region II. The solid lines 76A, 76B represent the behavior of the first and second normal modes in the resonator of the present invention, in which the boundary conditions at the ends of the resonator are designed so as to preserve the chiralities of the normal modes. At the zero magnetization level 77, the first and second modes have the same wavelength, arising from the uniformity of the medium within the stripline cross-section; thus, the two resonances are degenerate at $f_0$. As the magnetization M increases in the partially-magnetized regime I, the degeneracy is lifted and the frequencies of the first and second modes drift apart, initially in a linear manner as functions of M, changing at an enhanced rate as compared with the case of interchange of the modes as shown by the dashed curve 74, and as compared with prior-art single-mode devices. At the point of magnetic saturation 80 (in reality a more or less gradual transition, depending on the properties of the magnetic medium and on the configuration of the magnetic circuit), a magnetic field H is applied to vary the resonance frequencies further. Further increase of the externally-applied magnetic field H can no longer produce an increase of M, but it can continue to influence the Polder permeability tensor and thereby confer additional tunability in the present dual-mode case 76A, 76B as it does in the prior-art single-mode case. Note, however, that a large external magnetic field (2000 Oe) must be applied in the disadvantageous case 74, and in the comparable prior-art single-mode case, in order to realize tunability of 1.8 units on the frequency scale. This is to be compared to a similar magnitude of tunability achieved in the case of the upper mode 76A near magnetic saturation, point 80, with only a very weak externally-applied field, in the dual-mode case of the present invention.

FIG. 3B represents the case of an unbalanced configuration; for example, microstrip, having an inhomogeneous cross-section with a single magnetic substrate below the resonator and empty space above, as shown in FIG. 1. Here, the degeneracy of the even and odd modes is already lifted in the unmagnetized state 71, because the velocities of propagation are unequal due to the inhomogeneity of the medium. The electromagnetic field of the odd mode is concentrated to a greater degree in the empty space above the substrate and propagates faster than the even mode, as previously described. The dashed lines 70A, 70B represent the case of unfavorable boundary conditions, comparable to the prior-art single-mode case. There is a modest increase of resonance frequency on the part of both modes with increasing M. In contrast the solid lines 72A, 72B represent the behavior in accordance with the present invention. Although the dependence is initially quadratic, therefore slower at first than in the homogeneous case of FIG. 3A, nevertheless the tuning is significantly enhanced as compared with those of 70A, 70B and as compared with the prior-art single-mode case.

Figure 4:
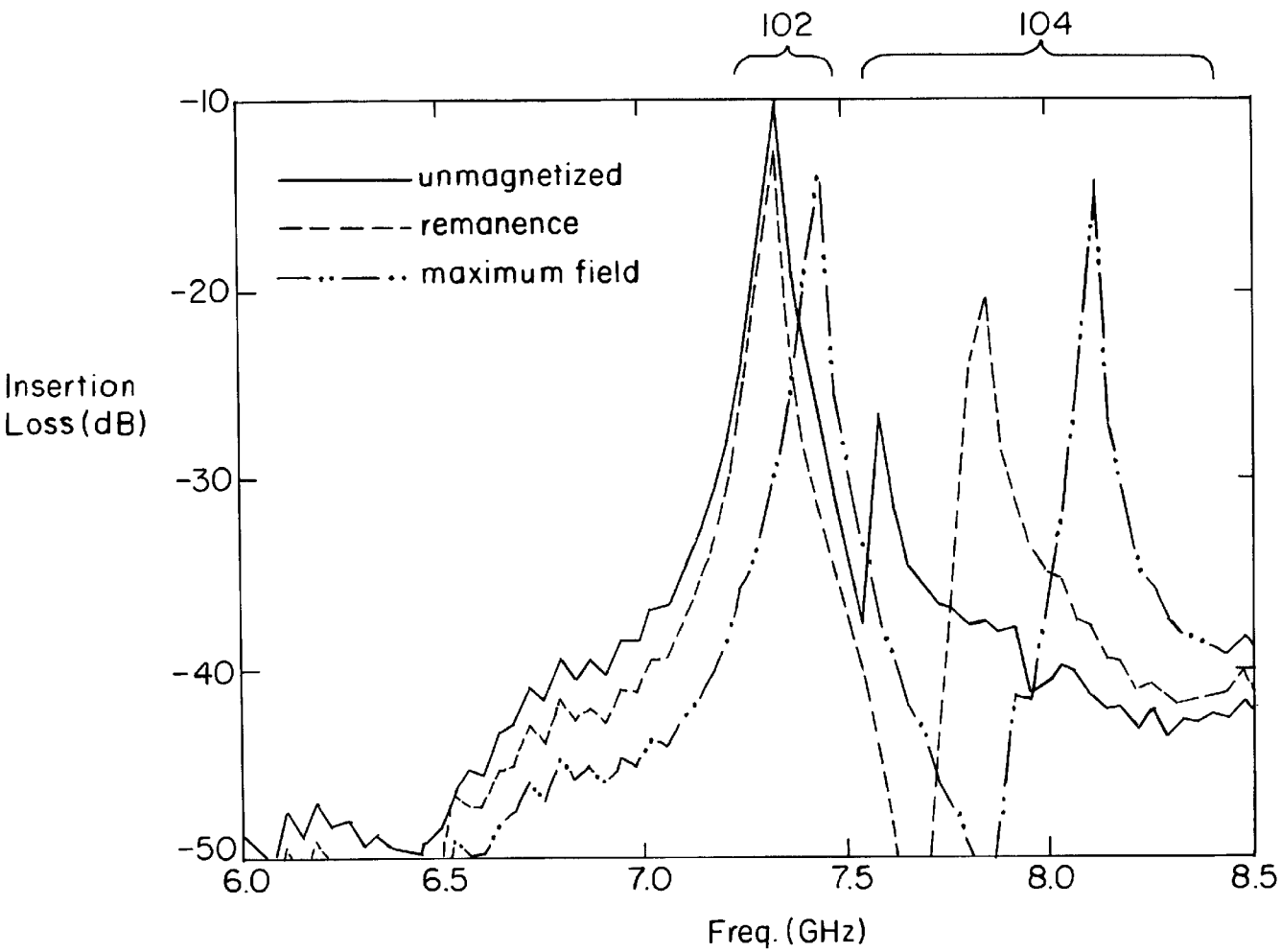
FIG. 4 is a chart of experimentally-measured insertion loss as a function of frequency, illustrating three magnetic states of the substrate: unmagnetized, remanent magnetization, and under maximum applied field, in accordance with the present invention.

FIG. 4 is a chart of experimentally-measured insertion loss (dB) as a function of frequency (GHz) for the unbalanced resonator plotted in FIG. 3B, illustrating the respective behaviors of the first and second modes at various magnetization levels. Of the two modes, the first mode 102 exhibits a lesser degree of tunability in this range. The resonance frequency of the first mode 102 is initially 7.3 GHz in the unmagnetized state, remains at or near 7.3 GHz in the remanence state, and increases to 7.45 GHz when maximum available external field is applied. Enhanced tunability is demonstrated by the second mode 104, which has a resonance frequency initially of 7.6 GHz at zero magnetization, increasing to 7.85 GHz at remanence, and to 8.1 GHz at maximum external field. With efficient magnetic circuit design, the maximum applied field can confer magnetic saturation. Further enhancement of tunability can be realized through control over microwave demagnetizing effects, as described in Charles Kittel, "On the Theory of Ferromagnetic Resonance Absorption," *Physical Review*, Vol. 73, No. 2, pgs. 155–161, (1948).

Figure 5A:
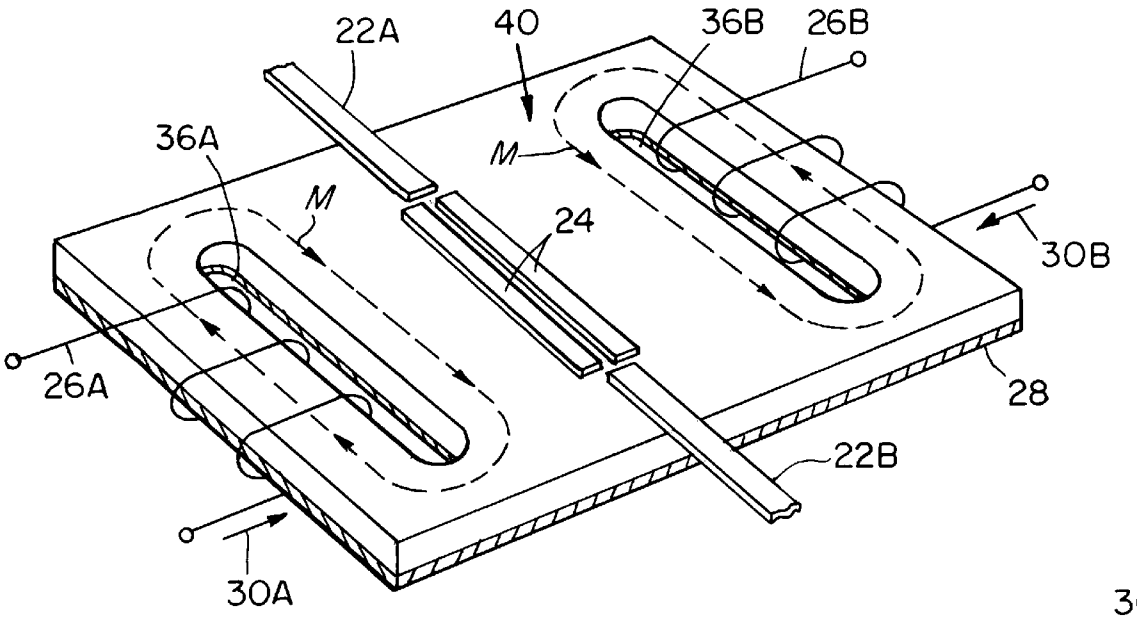
FIGS. 5A–5F are perspective illustrations of alternative embodiments of the present invention.

FIGS. 5A–5F illustrate alternative embodiments of the present invention. In the configuration of FIG. 5A, the resonator strips 24 are capacitively coupled at their ends to the transducer ports 22A, 22B. The magnetic substrate 40 is formed in the shape of dual closed loops, having dual openings 36A, 36B, each having a magnetization-inducing coil 26A, 26B, for enhancing the uniformity of the magnetization M in the region of gyromagnetic interaction near the resonator 24.

Figure 5B:
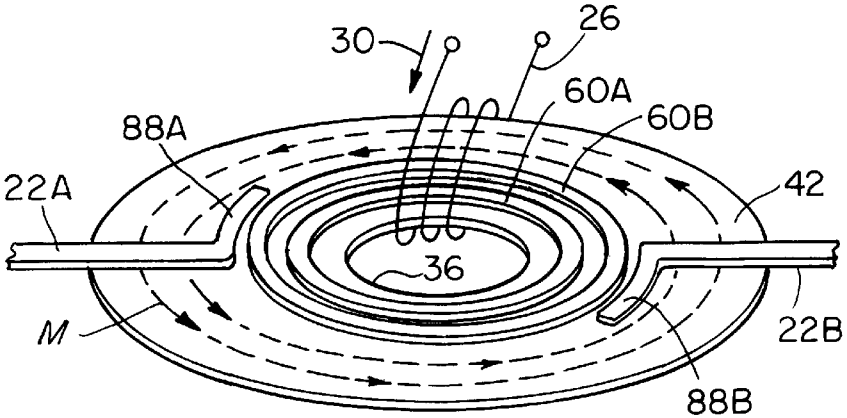

FIG. 5B illustrates a conceptual embodiment having a circular magnetic substrate 42 magnetized in its plane by coil 26 preferably wrapped uniformly around the circumference of the substrate through opening 36. The resonators 60A, 60B are closed-loop and concentric with the opening. The transducers 22A, 22B include legs 88A, 88B which run parallel to the resonator loops 60A, 60B to optimize capacitive coupling. This embodiment eliminates the problem with reflection at the ends of the resonator, as the resonator strips 60A, 60B have no ends, minimizing radiation loss and minimizing mixing of the two modes. If wound properly, this embodiment provides a uniform magnetization M about the circumference, thereby providing an advantageously square hysteresis loop for the substrate material.

Figures 5C, 5D:
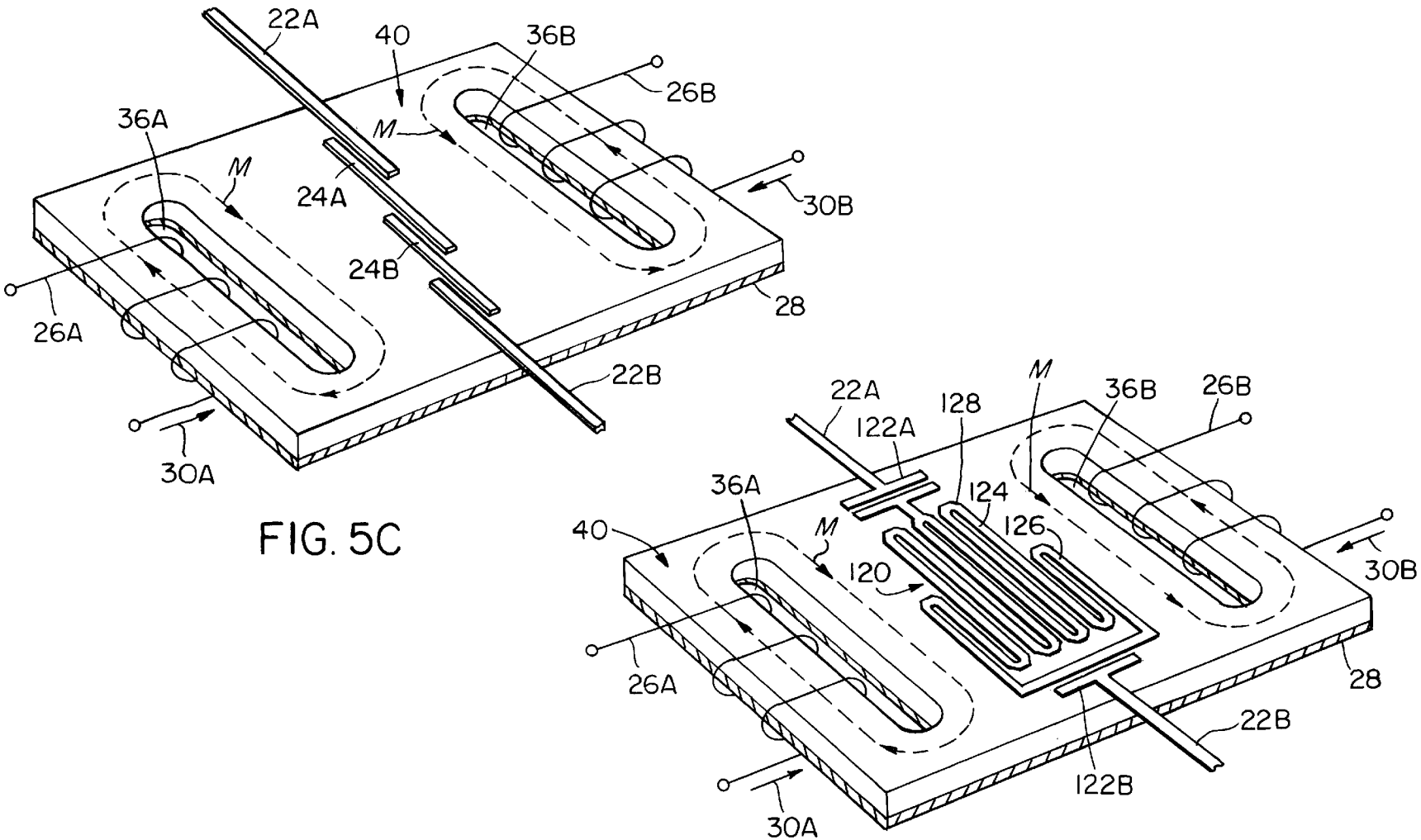

FIG. 5C illustrates an embodiment having a magnetic structure similar to that of FIG. 5A; however, in this embodiment, the resonator transmission lines 24A, 24B are spatially shifted along their longitudinal axes. For example, each resonator line 24A, 24B can have a length of one-half wavelength, and the amount of overlap between the lines can be one-quarter wavelength. This embodiment illustrates the idea of a multipole filter. The lengths of the coupled-line regions can be adjusted for optimal performance.

In the case of resonators in the form of a closed loop or ring, the cyclic nature of the boundary condition for propagation around the loop admits the possibility of waves circulating primarily in a single direction, clockwise or counterclockwise, tending to influence the nonreciprocal aspect of the gyromagnetic interaction in the coupled-line part of the loop. FIG. 5D illustrates a filter embodiment including a ring or loop resonator transducer ports 2 transducer ports 22A, 22B are capacitively coupled to the resonator 120 at terminals 122A, 122B. The resonator 120 comprises a meanderline whose two ends are connected to form a closed loop. The outer two legs 126 of the meanderline are preferably one-eighth wavelength, so as to optimize the condition of elliptical polarization, while the inner legs 124 are preferably one-quarter wavelength for maximal gyromagnetic interaction. The resonator lines 120 are preferably chamfered 128 at the corners to reduce unwanted or spurious reflections.

Figure 5E:
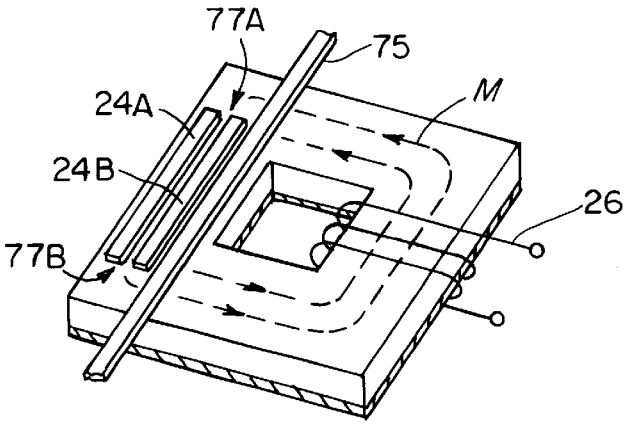

FIG. 5E illustrates the present invention configured as a band-reject filter. In this embodiment, the role of the transducers is played by the end portions 77A, 77B of the resonator in close proximity to a main transmission line 75. An electromagnetic wave sails through the main transmission line 75 substantially unhindered, except for any portion of the wave which substantially matches the resonance frequency of the resonator, and therefore excites an internal wave within the resonator. The resonance frequency is tunable by varying the magnetization M by coil 26.

Figure 5F:
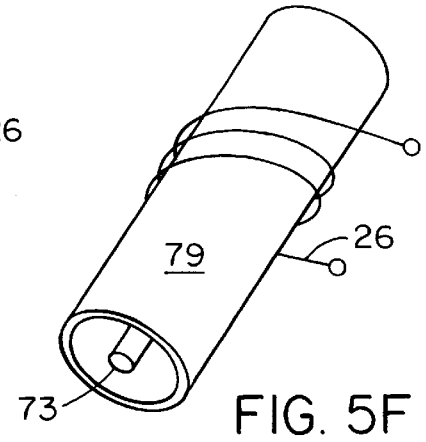

Also applicable to the present invention are non-planar transmission lines, for example conducting-tube circular-cylinder waveguide resonators as shown in FIG. 5F, physically analogous to balanced stripline in that the horizontally and vertically polarized waveguide modes propagate with equal velocity. Further applicable are rectangular or elliptical-cylinder waveguides in which the difference between the narrow and wide dimensions is not too great (specifically, is such that waves of both polarizations can propagate; i.e., neither is in "cut-off" at the frequency of interest), analogous to microstrip in that the velocities are unequal. In each of these cases, a magnetic medium, for example in the form of a ferrite rod 73 mounted along the longitudinal axis of the conducting tube 79, is magnetized along the axis of propagation, and, ordinarily, located on or near the axis where the Faraday rotation effect is greatest. The cross-section of the rod 73 therefore occupies a "zone of interaction" in which the wave pattern has a strong resemblance to that in the zone 65 of the microstrip case of FIG. 2. In an unmagnetized state, the cylindrical conductor is supportive of two normal modes of propagation. Discontinuities such as irises are located suitably beyond the ends of the rod to form a resonator structure at the desired frequency. The introduction of magnetization causes gyromagnetic interaction, which splits the two degenerate modes, resulting in elliptically polarized modes of opposite chirality, causing them to resonate between the discontinuities and as a result, the two modes resonate at different frequencies, such that the embodiment is operable as a tunable filter. Note that in this example, the discontinuities may be inductive or capacitive, but, as explained above, they should preferably preserve the chiralities of the respective modes.

Figure 6A:
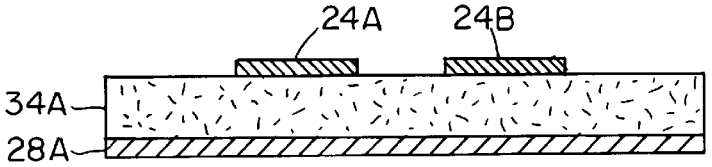
FIGS. 6A, 6B, 6C and 6D are cross-sectional views of various alternative planar configurations, illustrating a tunable resonator having a single layer of gyrotropic material, dual layers of gyrotropic material, dual layers each with ground planes, and with conductors embedded in the gyrotropic material, respectively, in accordance with the present invention.

FIGS. 6A–6D illustrate cross-sectional views of alternative planar technologies. FIG. 6A illustrates a planar gyrator having a single gyrotropic substrate 34A, coupled conducting transmission line strips 24A, 24B, and a ground plane 28A.

In the embodiment of FIG. 6A, the resonance spectra of the first and second normal modes do not in general coincide, due the inequality of the propagation constants of the two modes, a familiar complication with microstrip technology. To minimize this effect, a plate, or superstrate, of material 34B having a dielectric constant approximately equal to that of the substrate can be applied to the top of the circuit 24A, 24B, as illustrated and described below in conjunction with FIGS. 6B–6D. If the applied superstrate 34B were in fact of the same ferrite composition as that of the substrate 34A and appropriately magnetized, it could serve the additional purpose of increasing the magnetic interaction, thus enhancing the magnitude of the tuning effect. Without an upper ground plane on the superstrate, the configuration would constitute two-layered microstrip (FIG. 6B), or with an upper ground plane 28B, balanced stripline (FIG. 6C).

Figure 6B:
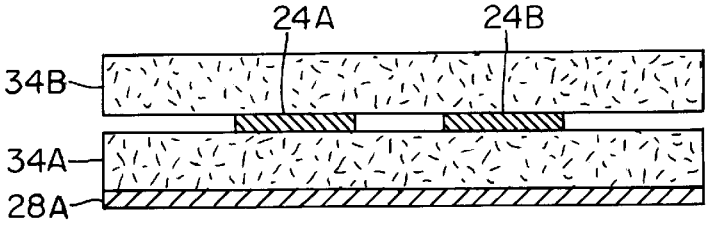

In the microstrip embodiment of FIG. 6B, a second gyrotropic layer 34B, is applied to the upper surface of the circuit 24A, 24B opposite the first layer 34A. Such a configuration confers several significant advantages. First, it mitigates the disadvantageous effects of an inhomogeneous dielectric cross-section which gives rise to unequal propagation constants for the even and odd modes, tending to degrade the performance. Second, both the upper 34B and lower 34A gyrotropic layers contribute to the nonreciprocal action, tending to increase the gyrotropic effect by at least a factor of two. Third, in this configuration, each of the layers could form the legs of a magnetic circuit, leading to a very efficient high remanent state with low-energy and high-speed switching. If this dual gyrotropic layer arrangement is incompatible with the magnetic circuit requirements or other mechanical constraints of the application in question, a dielectric overlay applied to the upper surface having a dielectric constant similar to that of the ferrite substrate would still confer the first advantage mentioned above.

Figure 6C:
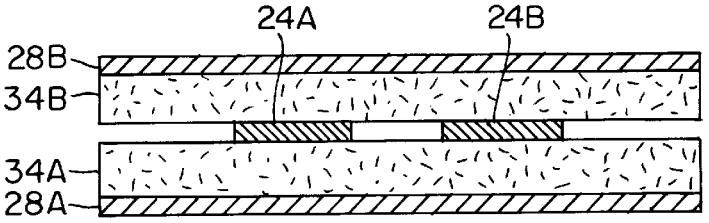
Figure 6D:
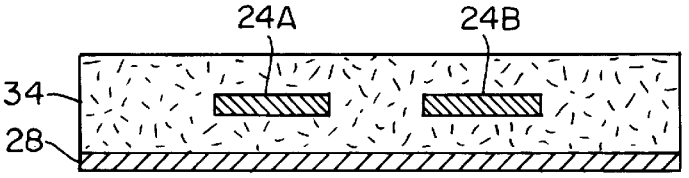

The embodiment of FIG. 6C adds a second ground layer 28B to the upper layer of gyrotropic material 34B. The resulting balanced stripline configuration confers additional confinement and shielding of the device and would be expected to lead to optimum strength of the gyromagnetic interaction. In FIG. 6D, the conductors 24A, 24B are embedded in the gyrotropic material 34, eliminating disadvantageous gaps in the magnetic medium in the plane of the conductors, between and beside the conductors 24A, 24B.

Figure 7:
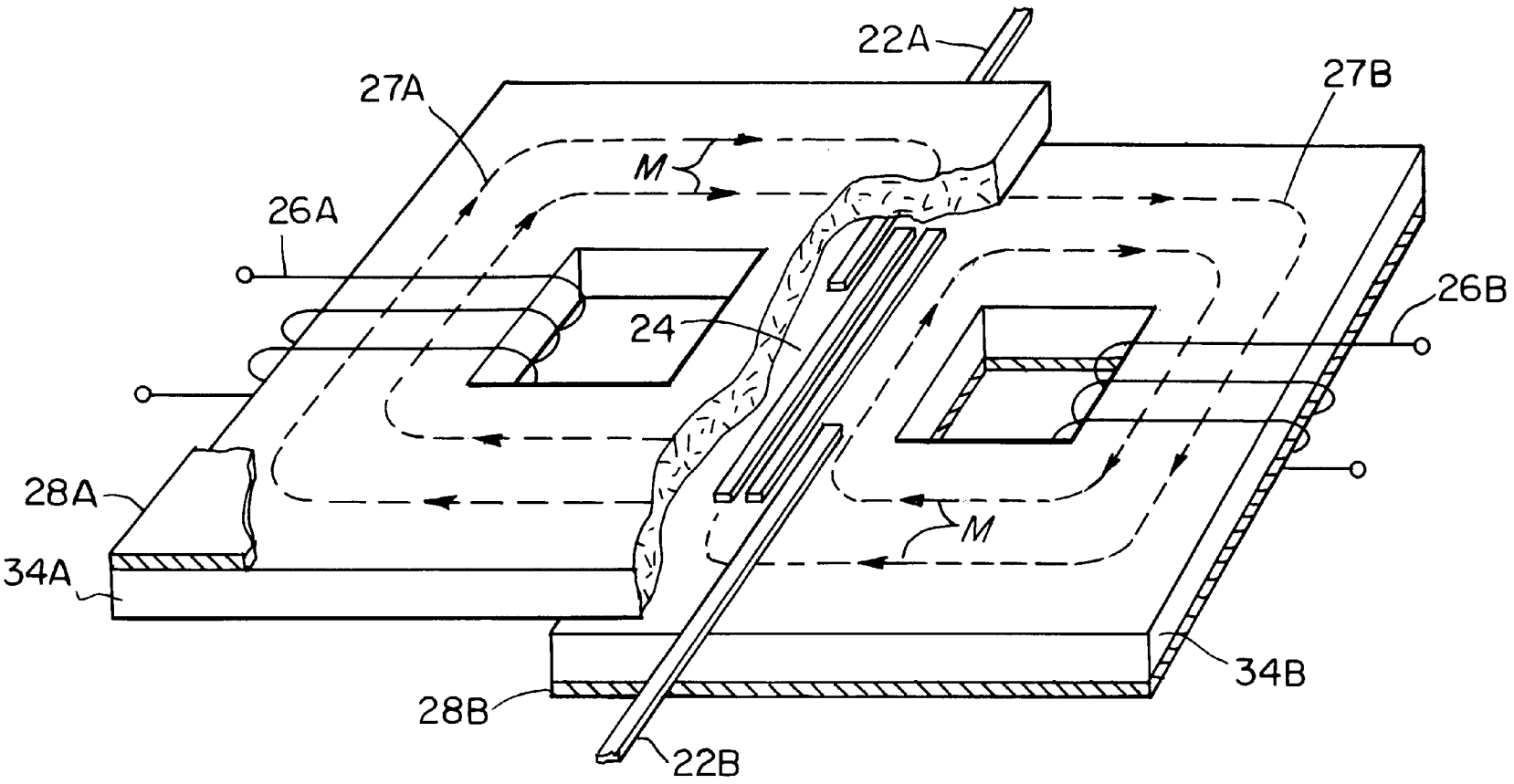
FIG. 7 is a perspective view of a planar circuit resonator in a balanced stripline configuration, having upper and lower gyrotropic substrates magnetized in opposite directions to confer maximum tunability in accordance with the present invention.

For maximum benefit, the upper and lower ferrite wafers of FIG. 6C are preferably magnetized in opposite directions; that is, parallel and anti-parallel to the directions of the strips, to correspond with the opposite senses, or left- and right-handed chirality, of circular polarization of the wave field above and below the plane of the strips. Such a configuration would give rise to a degenerate pair of resonances which would be split in a variable manner if the ferrite is partially magnetized. FIG. 7 is a sectional perspective view of such an embodiment. The upper and lower substrates 34A, 34B each are closed-loop structures magnetized by coils 26A, 26B. This embodiment would confer the advantages described above in accordance with FIGS. 6B–6D.

Within the above general sketch of the concept of a tunable filter, considerable flexibility exists for optimization and adaptation to specific frequency bands, geometrical and electrical constraints, and system objectives by means well known to those skilled in the art.

Tuning is especially effective in the regime of partial magnetization between the forward and reverse magnetic saturation points of the structure as disclosed in U.S. application Ser. No. 08/738,635, by Dionne, G. F.; and as disclosed in Dionne, G. F. and Oates, D. E., "Tunability of Microstrip Ferrite Resonator in the Partially Magnetized State," *IEEE Transactions on Magnetics*, Vol. 33, No. 5, (September 1997), the contents of which are incorporated herein by reference. In this range, the device operates with a weak applied magnetic field. This is in contrast with prior art techniques which generally operate in the saturated regime for the purpose of driving the device into a condition approaching a state of magnetic resonance, requiring a large magnetic field and generally resulting in disadvantageously high signal loss.

In an experimental model, the inventors demonstrated a tuning range of 270 MHZ about a center frequency of 7.7 GHZ, a range of about 3.6%. Work with a computational model indicates that a wider tuning range is feasible.

While this invention has been particularly shown and described with references to preferred embodiments thereof, it will be understood by those skilled in the art that various changes in form and detail may be made herein without departing from the spirit and scope of the invention as defined by the appended claims.

For example, the magnetization M may be remanent or otherwise induced by an active magnetic field. The magnetic structure is preferably formed in a continuous closed-loop configuration, for example in a toroidal topology or window-frame geometry as described above, however open configurations are also applicable. Where the gyrotropic medium is formed in a closed path, it can be magnetized by an initial latching current and operated in a remanent state, that is, without further excitation by an external magnet or coil.

By configuring the structure in a toroidal geometry, the magnetization can be confined within the structure, such that the structure is magnetized in its plane, parallel to the orientation of the transmission lines. This enhances the design and performance of the planar circuit. Further, it also affords compatibility with high-temperature superconductors, as disclosed in U.S. Pat. No. 5,484,765, by Dionne et al., the contents of which are incorporated herein by reference, in that, in this configuration, magnetic fields penetrating into the conductor are of negligible magnitude, and so are incapable of quenching its superconductive properties.

The gyrotropic material of the magnetic structure may comprise polycrystalline or single-crystal material, preferably, but not necessarily in a toroidal configuration. If a single crystal ferrite structure is employed, the structure is preferably configured in a toroidal shape. A gap may be introduced in the single crystal structure to shear the structure's magnetization curve, thereby allowing for variable control over the magnetization of the structure as a function of applied magnetic field, conferring the advantages described in U.S. patent application Ser. No. 08/738,635, by Dionne, cited above. Examples of magnetic polycrystalline or single crystal materials include: yttrium-iron garnet with various substitutive elements such as aluminum, etc., incorporated to confer specific properties; nickel-spinel ferrite; lithium-spinel ferrite; magnesium-manganese-spinel ferrite families.

There is a tendency for microwave current to be concentrated at the sharp edges of a conductor, leading to undesirable ohmic conductive energy loss. This phenomenon is a problem in a typical photolithographically deposited planar-circuit strip which generally has not only more or less thin, but furthermore ragged or uneven edges resulting from the etching process. One technique for avoiding the resulting signal loss is to employ high- or low-temperature superconducting technology, as cited above. In another technique, the strip conductors are formed to be generally elliptical in cross-section or otherwise so as to create a smooth, rounded profile, and placed on or embedded in the substrate. The rounded corners of the conductor result in reduced current concentration and thereby reduced loss. The use of gold or other conventional (i.e., non-superconducting) rounded-profile conductors in combination with cryogenic temperatures is still another effective means for reducing conduction loss in planar circuit devices. Other techniques for modifying the current distribution to concentrate current flow away from the edges of the conductors may also be employed. Note that for purposes of the present disclosure, the term "planar", when referring to conductors, includes and is not limited to the following conductors: standard photolithographically deposited planar conductors; conductors of elliptical or otherwise suitably shaped cross-section; and planar superconductors.

As an alternative to the use of a "sheared" hysteresis loop for precise continuous control of the level of partial magnetization, the known technique of "flux drive" is available. Flux drive utilizes a well-known principle, namely Faraday's law of electromagnetic induction, in order to produce precisely metered changes in the remanent magnetic state of a magnetic yoke serving as the active medium of a magnetically variable microwave device. In accordance with that law, application to the control winding of the magnetic circuit of a current impulse (such as a current of fixed magnitude gated on and off in a prescribed time interval) yields a corresponding change in the magnetic flux linked to the winding. With suitable design, this translates into the desired change in microwave phase (in a phaser) or resonance frequency (in a tunable filter), etc. With selection of a gyrotropic material having suitably square hysteresis properties, the device remains "latched" in the desired remanent state of partial magnetization after the current pulse has ended. This method lends itself especially to device control in prescribed digital steps, with very high efficiency (in that no energy is required to maintain the latched state), in situations where a low-coercivity square-loop material can be designed so as to deliver the flux changes effectively to the site of microwave interaction.

We claim:

1. An electromagnetic device comprising:

a resonator supportable of first and second normal modes of substantially orthogonal polarizations; each of said first and second normal modes having a resonance frequency; and a gyrotropic medium sufficiently proximal to the resonator to interact gyromagnetically therewith for shifting the resonance frequency of at least one of said modes.

2. The electromagnetic device of claim 1 further comprising means for setting the medium permeability, thereby controlling the effective resonator path length, for tuning the resonance frequency of at least one of said modes.

3. The electromagnetic device of claim 1 wherein the means for setting the medium permeability modifies the magnetization of the gyrotropic medium.

4. The electromagnetic device of claim 3 wherein the magnetization is variable between forward and reverse saturation levels.

5. The electromagnetic device of claim 3 wherein the magnetization is variable between unmagnetized and remanence states for varying the condition of gyromagnetic interaction, thereby tuning the resonance frequency.

6. The electromagnetic device of claim 2 wherein the means for setting the medium permeability modifies the magnetic field within the gyrotropic medium.

7. The electromagnetic device of claim 1 further comprising first and second transducers coupled to the resonator at opposite ends thereof.

8. The electromagnetic device of claim 7 wherein the transducers are adapted to preserve the identities of the orthogonal polarizations of the first and second modes.

9. The electromagnetic device of claim 1 wherein the resonator comprises at least one pair of parallel conductors.

10. The electromagnetic device of claim 9 wherein the conductors are shaped to reduce conduction loss.

11. The electromagnetic device of claim 1 wherein the gyrotropic medium comprises a closed-loop magnetic structure magnetized in the plane of the structure.

12. The electromagnetic device of claim 1 wherein the resonator is formed of a superconducting material.

13. The electromagnetic device of claim 1 wherein the resonator comprises waveguide selected from the group consisting of: hollow tube waveguide; parallel conductor waveguide; H-guide; dielectric waveguide; co-planar waveguide; and slotline waveguide.

14. The electromagnetic device of claim 1 wherein the resonator comprises a circular-cylindrical waveguide and wherein the gyrotropic medium comprises a magnetic rod disposed along the axis of said waveguide.

15. The electromagnetic device of claim 1 wherein the gyrotropic medium comprises a magnetic substrate and wherein the resonator comprises strip conductors deposited on said substrate.

16. The electromagnetic device of claim 15 further comprising a second magnetic substrate adjacent said resonator opposite the first magnetic substrate.

17. The electromagnetic device of claim 1 wherein the gyrotropic medium comprises a circular magnetic substrate tangentially magnetized in its plane and wherein the resonator comprises a pair of closed-loop microstrip conductors concentric with the magnetic substrate.

18. The electromagnetic device of claim 1 wherein the resonator comprises a closed-loop ring resonator.

19. The electromagnetic device of claim 18 wherein the ring resonator includes a meanderline, the ends of which are coupled to form a closed loop.

20. The electromagnetic device of claim 1 wherein the resonator comprises at least one pair of parallel conductors, and further comprising a transmission line proximal to the resonator, such that the device is operable as a band-reject filter.

21. The electromagnetic device of claim 1 including multiple resonators such that the device is operable as a multipole filter.

22. A tunable filter comprising:

a resonator supportable of first and second normal modes of substantially orthogonal polarizations; each of said first and second normal modes having a resonance frequency;

first and second transducers coupled to the resonator for supplying electromagnetic energy to the resonator and for removing electromagnetic energy from the resonator;

a gyrotropic medium sufficiently proximal to the resonator to produce gyromagnetic interaction with the normal modes, such that an electromagnetic signal introduced at the first transducer propagates within the resonator with phase constants for each of the normal modes that are controlled by the magnetic state of the medium; and means for setting the medium magnetic state, thereby controlling the effective resonator path length, for tuning the resonance frequency of at least one of said modes.

23. The tunable filter of claim 22 wherein the means for setting the medium magnetic state modifies the magnetization of the gyrotropic medium.

24. The tunable filter of claim 23 wherein the magnetization is variable between unmagnetized and remanence states for varying the condition of gyromagnetic interaction, thereby tuning the resonance frequency.

25. The tunable filter of claim 22 wherein the means for setting the medium permeability modifies the magnetic field within the gyrotropic medium.

26. The tunable filter of claim 22 wherein the resonator comprises at least one pair of parallel conductors.

27. The tunable filter of claim 22 wherein the gyrotropic medium comprises a closed-loop magnetic structure magnetized in the plane of the structure.

28. The tunable filter of claim 22 wherein the resonator is formed of a superconducting material.

29. The tunable filter of claim 22 wherein the resonator comprises a closed-loop ring resonator.

30. A method for forming an electromagnetic device comprising:

forming a resonator of at least two substantially parallel conductors, such that said resonator is supportable of first and second normal modes of substantially orthogonal polarizations, each of said first and second normal modes having a resonance frequency; and disposing said resonator in sufficient proximity with a gyrotropic medium such that wave fields of said normal modes propagating on the resonator interact gyromagnetically therewith; said gyrotropic medium having a variable magnetic state which varies the medium permeability, thereby changing the effective resonator path length, for causing corresponding shift in said resonance frequency of at least one of said modes.

* * * * *

UNITED STATES PATENT AND TRADEMARK OFFICE

CERTIFICATE OF CORRECTION

PATENT NO.: 5,949,311

DATED: September 7, 1999

INVENTOR(S): Jerald A. Weiss, Donald H. Temme, and Gerald F. Dionne

It is certified that errors appear in the above-identified patent and that said Letters Patent is hereby corrected as shown below:

`Title page, item[56] line 1`

Other Publications, please change "Rigurous" to --Rigorous– : `line2` change "21" to –21st–. change "Planare" to –Planar–, `line3` change "Microwavee" to –Microwave".

In the second paragraph under Other Publications, in the second line, please change "PAartially MAgnetized" to –Partially Magnetized--.

Signed and Sealed this

Second Day of May, 2000

*Attest:*

Q. TODD DICKINSON

*Attesting Officer*

*Director of Patents and Trademarks*